US009624627B2

(12) United States Patent
Wang

(10) Patent No.: US 9,624,627 B2
(45) Date of Patent: Apr. 18, 2017

(54) TELESCOPIC SCREED AND PAVING MACHINE THEREOF

(71) Applicant: DYNAPAC (CHINA) COMPACTION & PAVING EQUIPMENT CO., LTD., Tianjin (CN)

(72) Inventor: Youbao Wang, Tianjin (CN)

(73) Assignee: DYNAPAC (CHINA) COMPACTION & PAVING EQUIPMENT CO., LTD., Tianjin (CN)

( * ) Notice: Subject to any disclaimer, the term of this patent is extended or adjusted under 35 U.S.C. 154(b) by 27 days.

(21) Appl. No.: 14/803,651

(22) Filed: Jul. 20, 2015

(65) Prior Publication Data

US 2016/0040369 A1 Feb. 11, 2016
US 2016/0273173 A2 Sep. 22, 2016

(30) Foreign Application Priority Data

Aug. 6, 2014 (CN) ..... 2014 1 0385319

(51) Int. Cl.
*E01C 19/48* (2006.01)

(52) U.S. Cl.
CPC ..... *E01C 19/48* (2013.01); *E01C 2301/16* (2013.01); *E01C 2301/20* (2013.01)

(58) Field of Classification Search
CPC ... E01C 19/48; E01C 2301/16; E01C 2301/20
USPC ..... 404/84.05–86, 96, 104, 105, 114, 118
See application file for complete search history.

(56) References Cited

U.S. PATENT DOCUMENTS 5,860,764 A * 1/1999 Roberts ..... E01C 23/0993 404/124
6,352,386 B2 * 3/2002 Heims ..... E01C 19/48 404/112
7,651,295 B2 * 1/2010 Eppes ..... E01C 19/48 404/101
8,221,025 B2 * 7/2012 Buschmann ..... E01C 19/48 404/75

FOREIGN PATENT DOCUMENTS

CN 100564682 C 12/2009
CN 101748680 A 6/2010
CN 101812823 A 8/2010
DE 102014006210 A1 * 2/2013 ..... E01C 19/42
EP 2218824 A1 8/2010

* cited by examiner

*Primary Examiner* — Raymond W Addie
(74) *Attorney, Agent, or Firm* — Carter, DeLuca, Farrell & Schmidt, LLP

(57) ABSTRACT

A telescopic screed includes main section and telescopic section screeds. The main section screed includes a screed frame and a base plate. The telescopic section screeds are arranged on the left side and/or the right side of the main section screed and include a cross slope framework, a cross slope driver, at least two multistage sliding pipes, a telescopic frame, a telescopic driver, a telescopic section frame, a telescopic section base plate and an elevation difference driver. The cross slope framework is pivotally connected with the main section screed to adjust the cross slope. The multistage sliding pipes are used for transversely guiding the telescopic frames to achieve the telescopic ability of the telescopic section screeds. The telescopic section frame is connected with the corresponding telescopic frame to move up and down to adjust the relative height between the telescopic section frame and the telescopic frame.

10 Claims, 5 Drawing Sheets

TELESCOPIC SCREED AND PAVING MACHINE THEREOF

TECHNICAL FIELD

The present invention relates to a telescopic screed, particularly to a telescopic screed with telescopic section screed thereof being telescopic in the paving width direction relative to a main section screed and also adjustable in the cross slope, and a paving machine comprising the same.

BACKGROUND OF RELATED ART

A screed is a very important work unit of a paving machine, responsible for smoothing and compressing the mixture to eventually form a road surface. In order to conveniently adjust the paving width of the paving machine, some screeds include a telescopic section screed and a main section screed. The telescopic section screed is telescopic in a transversal direction (the horizontal direction substantially perpendicular to the travelling direction of the paving machine, i.e. generally a paving width direction) with respect to the main section screed. The screed comprising a telescopic section screed and a main section screed is called a telescopic screed. Typically, the telescoping direction of the telescopic section screed is the paving width direction. It is also obvious that, for some telescopic section screeds, the telescoping direction and the paving width direction form a slight angle.

Telescopic screeds are usually classified into front telescopic screeds and rear telescopic screeds. The telescopic section screeds of the front and rear telescopic screeds are arranged in the front side and the rear side of the main section screed, respectively, and are telescopic transversely relative to the main section screed.

In addition, in regions such as North America and Australia, cross slopes are usually required on both sides of the road surface (the edges on both sides of the road surface are lower than the middle part of the road surface), so as to facilitate water drainage. FIG. 1 shows a cross-sectional view of such a road surface R, which includes a middle horizontal surface H and the cross slope surfaces S on both sides; the cross slope surface S has a cross slope with respect to the middle horizontal surface H; namely, there is a lateral inclination angle $\alpha$ between the cross slope surface S and the middle horizontal surface H. I represents an intersecting line between the cross slope surface S and the middle horizontal surface H. Therefore, the telescopic screed in these regions typically requires that the telescopic section screed thereof is adjustable in cross slopes relative to the main section screed.

The patent with the publication No. CN100564682C (and the priority No. U.S. 60/452,883) discloses an extension screed (i.e. a telescopic screed), comprising: a main screed (i.e. a main section screed); a base member movably connected with the main screed; a vertical actuator for connecting the main screed and the base member, each enabling the base member to move vertically or to pivot in a vertical plane; an inside framework movably connected with the base member; a first horizontal actuator which enables the inside framework to move horizontally with respect to the base member; an outside framework movably connected with the inside framework; a second horizontal actuator which enables the outside framework to move horizontally with respect to the inside framework; and a telescopic section screed connected with the outside framework. The main drawback of such screed lies in that the vertical actuator is connected in a manner of enabling the base member to move vertically and pivot, so the rigidity between the base member and the main screed becomes very poor, which significantly affects the quality of the paved road surface.

The patent with the application No. CN200910165203 (and the priority No. EP09002132) discloses a paving screed (i.e. a screed), comprising: a base screed (i.e. a main section screed); a base guiding structure pivotally connected to the base screed; a guiding sub-structure being transversely guided in the base guiding structure; a first actuator for enabling the guiding sub-structure to slide by a first stroke with respect to the base guiding structure; an extension guiding structure being transversely guided in the guiding sub-structure; a second actuator for enabling the extension guiding structure to slide by a second stroke with respect to the guiding sub-structure; and a base framework structure connected to the extension guiding structure through the vertical guiding part and the height adjustment assembly. The shortcomings of such screed lie in that there are two sets of guiding structures and two sets of actuators distributed in space, and thus a lot of space is occupied, and the spatial distribution of the two sets of guiding parts weakens the rigidity of the entire telescopic structure, further affecting the paving quality of the road surface.

The patent with the publication No. CN101812823B (the priority No. EP08021844.9) and the patent with the publication No. CN101748680B (the priority No. EP08021843.1) disclose a paving screed (i.e. a screed) and a method for laying a paving mat. The paving screed mainly comprises: a base screed (i.e. a main section screed); a main base plate arranged under the base screed; an extension guiding structure transversely and slidably connected to the base screed through several guiding assemblies; and a framework which is connected to the extension guiding structure through the vertical adjustment assemblies and the driving parts and whose relative height can be adjusted; a telescopic section base plate connected to the framework; a lateral inclination adjustment assembly for adjusting the cross slope of the telescopic section base plate with respect to the main section base plate, arranged between the vertical adjustment assemblies and the framework or between the framework and the telescopic section base plate. Disadvantage of such screed lies in that, when the telescopic section screed telescopes, the lateral positions of the intersecting lines between the cross slope surfaces at both sides and the middle horizontal surface will change, which is not allowed in many paving conditions. Therefore, it is necessary to add a complicated control system for controlling the screed, so as to maintain the lateral positions of the intersecting lines unchanged, which not only substantially increases the cost, but also brings about fault points and unreliability.

SUMMARY

Directing at the above-mentioned disadvantages of the screeds of the paving machine in the prior art, the present invention provides a telescopic screed which is of high structural rigidity, compact space and reliable performance.

In order to solve the above technical problems, the present invention adopts the technical solution as below:

a telescopic screed, comprising main section screeds and telescopic section screeds, wherein the main section screed comprises a main section screed frame and a main section base plate; the telescopic section screeds are arranged on the left side and/or the right side of the main section screed, and the telescopic section screed comprises:

a cross slope framework, pivotally connected with the main section screed, so that the cross slope framework can pivot relative to said main section screed in a plane which forms an angle of 80°-90° with the travelling direction;

a cross slope driver, which is connected with the main section screed and the cross slope framework, used for adjusting the cross slope of the cross slope framework with respect to the main section screed;

at least two multistage sliding pipes, each of the multistage sliding pipes comprising an outer pipe, at least one intermediate pipe and an inner pipe which are sequentially telescoped and can slide relatively along the axial direction, wherein the outer pipe is transversely fixed to the cross slope framework;

a telescopic frame moving transversely with respect to the cross slope framework, wherein the inner side of the telescopic frame is slidably connected to the outer pipe of the multistage sliding pipe and the outer side thereof is connected to the inner pipe of the multistage sliding pipe;

a telescopic driver for driving the telescopic frame to enable it to move transversely with respect to the cross slope framework;

a telescopic section frame connected to the lower portion of the telescopic frame in a manner of being able to move up and down;

an elevation difference driver connected between the telescopic frame and the telescopic section frame to adjust the height of the telescopic section frame relative to the telescopic frame;

a telescopic section base plate connected at the bottom of the telescopic section frame.

Preferably, the cross slope framework is pivotally connected to the front side of the main section screed by a pin shaft; the front side of the main section screed is provided with several arcuate holes; the cross slope framework and the main section screed are pre-tightened by the fasteners passing through said several arcuate holes.

Preferably, the cross slope driver is a hydrocylinder with one end thereof connected to the main section screed and the other end connected to the cross slope framework.

Preferably, there is one intermediate pipe and the multistage sliding pipe is a two-stage sliding pipe. The intermediate pipe and the outer pipe slide relative to each other, forming a first stroke of the two-stage sliding pipe. The inner pipe and the intermediate pipe slide relative to each other, forming a second stroke of the two-stage sliding pipe. The first stroke equals to the second stroke.

Preferably, there are two multistage sliding pipes, and the two multistage sliding pipes are arranged up and down; the telescopic driver is located at the middle position of the two multi-stage sliding pipes.

Preferably, the telescopic driver is a hydrocylinder, with one end thereof connected to the cross slope framework and the other end connected to the outer side of the telescopic frame.

Preferably, several long holes are arranged in the rear side of the telescopic section frame, and the telescopic section frame and the telescopic frame are pre-tightened by the fasteners passing through said several long holes.

Preferably, the elevation difference driver comprises two sets of transversely-arranged screw thread adjusting mechanisms. The screw thread adjusting mechanism comprises an upper bracket, and a lower threaded seat, and a screw rod, wherein the upper bracket is mounted on the telescopic frame; the lower threaded seat is mounted on the telescopic section frame; and the upper portion of the screw rod and the upper bracket are rotatably connected and the lower portion of the screw rod is provided with external threads matching with the lower threaded seat.

Preferably, the elevation difference driver further comprises a hydraulic motor and a chain. The hydraulic motor drives the rotation of the screw rod of the screw thread adjusting mechanism by the chain, so that the telescopic section frame approaches or departs from the telescopic frame.

The present invention also provides a paving machine comprising the telescopic screed described above.

As compared with the prior art, the telescopic screed and the paving machine thereof of the present invention have the following beneficial effects:

1. The telescopic screed of the present invention takes a multistage sliding pipe as a guiding part, the extended-out portion of the pipe of each stage can be at most about half of its length, namely, the portion that doesn't extend out is at least about half of its length (the inner pipe of the two-stage sliding pipe extends out about half of its length, and the pipe of each stage of a multistage sliding pipe with more than two stages extends out less than half of its length), in this way, the guiding performance will be improved inevitably.

2. Due to the telescopic property of the multistage sliding pipes, the multistage sliding pipes serving as guiding parts have smaller length when in the retracted state, so that the multistage sliding pipes on the left and right sides of the telescopic screed will not intersect with each other or enter into the other's space to cause interference. In this way, even when the telescopic section screed is in the retracted state, the cross slope can still be adjusted, enabling favorable adaptability to various operation condition.

3. The inner side of the telescopic frame supports the multistage sliding pipe while being slidably connected to the outer pipe of the multistage sliding pipe. The outer side of the telescopic frame is connected to the inner pipe. That is, both the inner side and the outer side of the telescopic frame are connected to the multistage sliding pipe, thereby increasing the structural rigidity of the telescopic screed.

4. The telescopic screed realizes transverse telescoping by only adopting two multistage sliding pipes and one telescopic driver, so it is very compact in space, which particularly means a lot to the front telescopic screed (which often requires more compact space).

5. When the telescopic screed telescopes transversely, the lateral positions of the intersecting lines between the cross slope surfaces on both sides and the middle horizontal surface will not change, so no additional control system is necessary.

6. In the telescopic screed provided in a preferred embodiment of the present invention, the cross slope framework and the main section screed therebetween, and the telescopic section frame and the telescopic frame therebetween are pre-tightened by fasteners, which increases the structural rigidity of the telescopic screed and further makes the road surface highly flat, achieving favorable road surface paving effect in the practical paving process.

6—left main section screed frame, 7—right main section screed frame, 8—main section base plate, 9—cross slope framework, 10—pin shaft, 11—arcuate hole, 12—fastener, 13—first hydrocylinder, 14—two-stage sliding pipe, 15—outer pipe, 16—intermediate pipe, 17—inner pipe, 18—telescopic frame, 19—second hydrocylinder, 20—telescopic section frame, 21—long hole, 22—fastener, 23—elevation difference driver, 24—screw thread adjusting mechanism, 25—upper bracket, 26—lower threaded seat, 27—screw rod, 28—hydraulic motor, 29—chain, 30—telescopic section base plate, L—stroke of the two-stage sliding pipe, L1—first stroke, L2—second stroke, M-center plane of the main section screed

DETAILED DESCRIPTION

To enable those skilled in the art to better understand the technical solution of the present invention, the present invention will be described in detail with reference to the accompanying drawings and the specific embodiments.

It should be appreciated that usually a telescopic screed has, at two sides, telescopic section screeds which are substantially symmetrical and transversely telescopic or adjustable with respect to the main section screed, and of course, the telescopic screed can also be provided with the telescopic section screed on only one side. FIGS. 2, 4, 5 and 6 of the present invention only show a telescopic screed having a telescopic section screed on one side (the left side).

In the figures, x-axis represents the travelling direction (positive direction indicating Front); y-axis represents the width direction of paving (positive direction indicating Left); z-axis represents the height direction (positive direction indicating Up). In addition, the outer side (inner side) of each part refers to the side far from (near) the center plane M of the main section screed.

As shown in FIGS. 2 to 10, an embodiment of the present invention provides a telescopic screed, comprising: a main section screed and a telescopic section screed.

Figure 1:
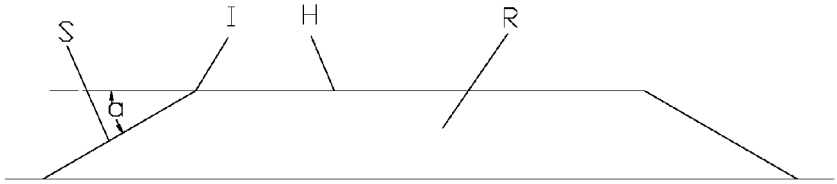
FIG. 1 is a cross-sectional schematic view of the road surface having a cross slope.
Figure 2:
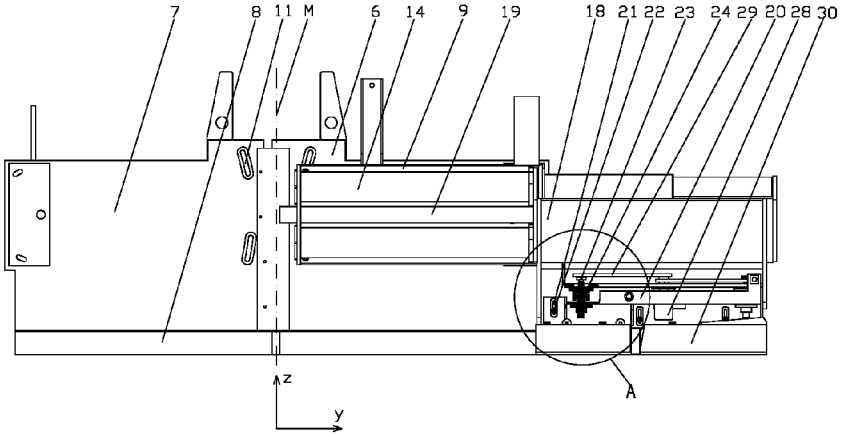
FIG. 2 is a front view of the telescopic screed of the present invention, which has no cross slope and whose telescopic section screed is at an extended position (in a view from front to back)

As shown in FIG. 2, the main section screed comprises a main section screed frame and a main section base plate 8. In this embodiment, the main section screed frame comprises a left main section screed frame 6 and a right main section screed frame 7.

The telescopic section screed comprises: a cross slope framework 9, a cross slope driver, at least two multistage sliding pipes, a telescopic frame 18, a telescopic driver, a telescopic section frame 20, a telescopic section base plate 30 and an elevation difference driver.

Figure 3:
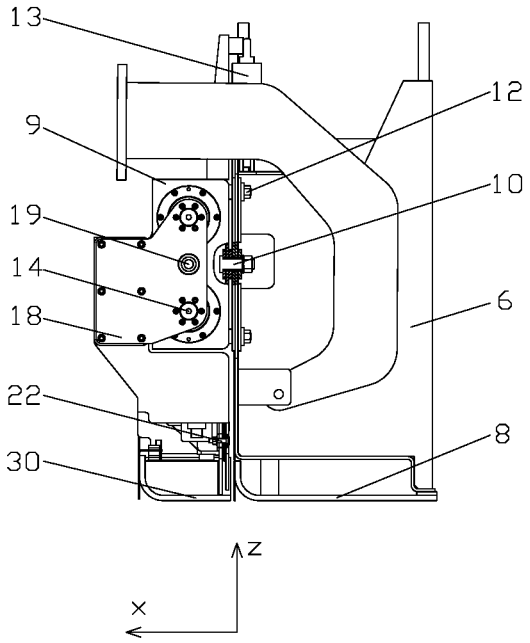
FIG. 3 is a right side view of FIG. 2.

As shown in FIGS. 2-3, the cross slope framework 9 is pivotally connected to the front side of the left main section screed frame 6 of the main section screed by a pin shaft 10, and pivots with respect to the left main section screed frame 6 in a plane which forms an angle of 80° to 90° with the travelling direction, i.e. pivots with respect to the left main section screed frame 6 in a plane which is substantially perpendicular to the travelling direction. Specifically, the cross slope framework 9 is in a frame shape structure formed by an inside panel, an outside panel, and a curved panel connecting the inside panel and the outside panel. Preferably, four arcuate holes 11 are disposed on the front side of the left main section screed frame 6, and the cross slope framework 9 and the left main section screed frame 6 therebetween are pre-tightened by four sets of fasteners 12 passing through the arcuate holes 11, so as to increase the structural rigidity of the connection between the cross slope framework 9 and the main section screed. If there are two telescopic section screeds, the two cross slope frameworks 9 of the two telescopic section screeds are installed, without interfering with each other, on the left main section screed frame 6 and the right main section screed frame 7, respectively.

Figure 5:
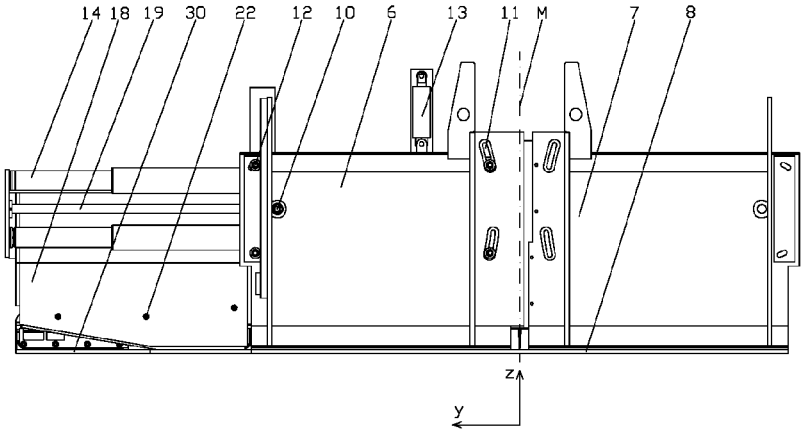
FIG. 5 is a rear view of FIG. 2.

As shown in FIG. 3 and FIG. 5, a cross slope driver is connected with the main section screed and the cross slope framework 9, to adjust the cross slope of the cross slope framework 9 relative to the main section screed. Specifically, a first hydrocylinder 13 is selected as the cross slope driver, with one end thereof connected to the main section screed and the other end connected to the cross slope framework 9.

Figure 4:
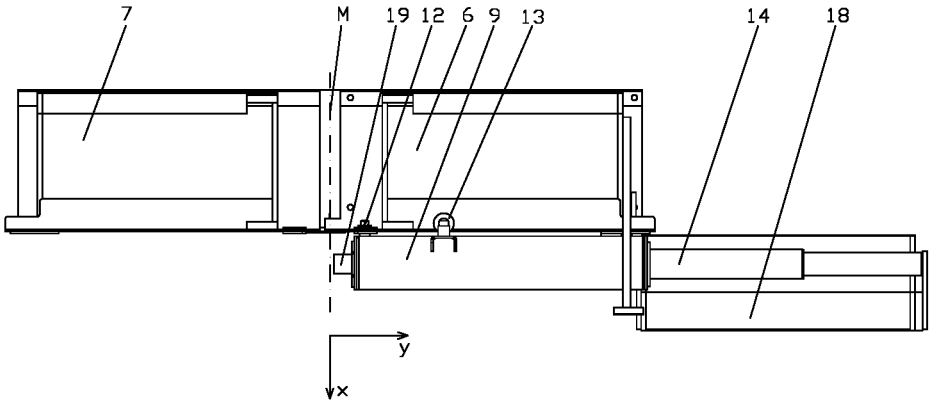
FIG. 4 is a top view of FIG. 2.
Figure 8:
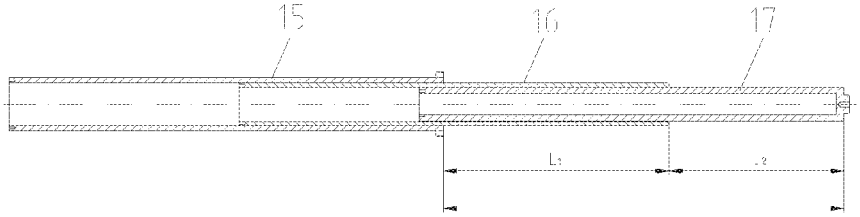
FIG. 8 is a sectional schematic view of the two-stage sliding pipe of the telescopic screed of the present invention.

As shown in FIG. 4 and FIG. 5, there are at least two multi-stage sliding pipes, and each comprises an outer pipe 15, at least one intermediate pipe 16, and an inner pipe 17 which are sequentially telescoped and axially slidable relative to each other. The inner side and outer side of the outer pipe 15 are fixed to the inside panel and the outside panel of the cross slope framework 9, respectively. Specifically, as shown in FIG. 8, the multi-stage sliding pipe is a two-stage sliding pipe 14, which specifically comprises an outer pipe 15, one intermediate pipe 16 and an inner pipe 17; the intermediate pipe 16 and outer pipe 15 slide relative to each other, forming a first stroke L1 of the two-stage sliding pipe 14; the inner pipe 17 and the intermediate pipe 16 slide relative to each other, forming a second stroke L2 of the two-stage sliding pipe 14. The first stroke L1 substantially equals to the second stroke L2, i.e. each is about half of the stroke L of the two-stage sliding pipe 14. The structure with two strokes being substantially equal makes the two-stage sliding pipe 14 have better guiding performance and rigidity. Specifically, as shown in FIG. 2, the two two-stage sliding pipe 14 may be disposed up and down and is transversely fixed to the cross slope framework 9 through the outer pipe 15.

Figure 6:
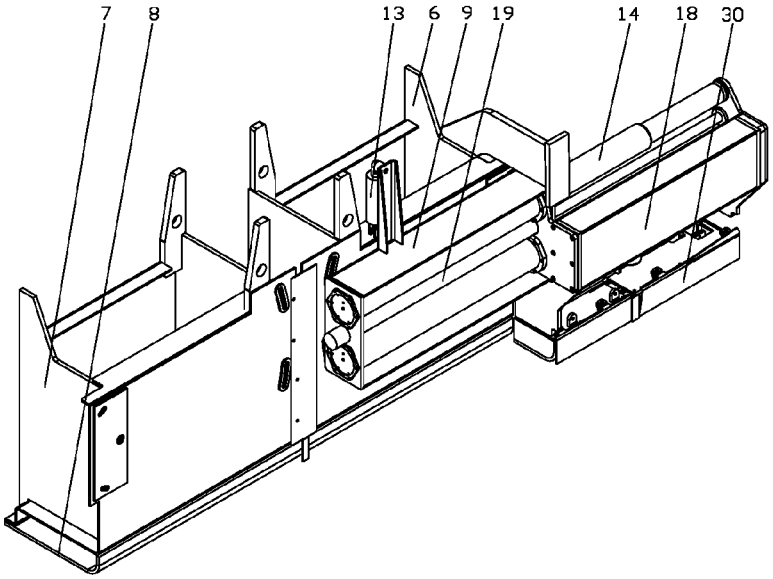
FIG. 6 is a three-dimensional view of the telescopic screed of the present invention which has no cross slope and whose telescopic section screed is at the extended position.

As shown in FIG. 6, the telescopic frame 18 moves transversely with respect to the cross slope framework 9, the inner side thereof being slidably connected to the outer pipe 15 of the two-stage sliding pipe, and the outer side thereof connected to the inner pipe 17 of the two-stage sliding pipe 14.

As shown in FIG. 6, the telescopic driver is used for driving the telescopic frame 18 to move transversely with respect to the cross-slope framework 9; in particular, a second hydrocylinder 19 may be selected as a telescopic driver, with one end thereof connected to the cross slope framework 9 and the other end connected to the outer side of the telescopic frame 18.

Figure 7:
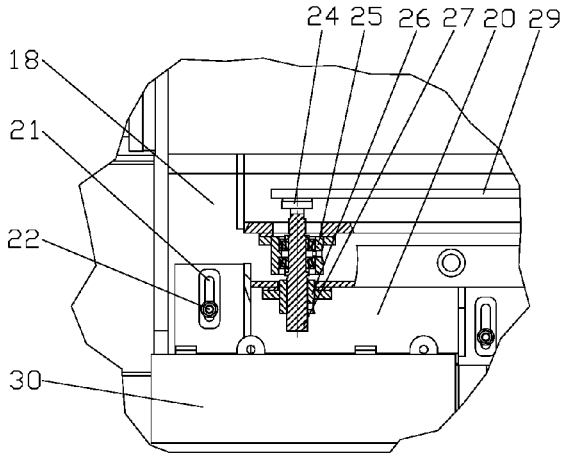
FIG. 7 is an enlarged view of the part A in FIG. 2.

As shown in FIG. 7, the telescopic section frame 20 is connected to the lower part of the telescopic frame 18 in a manner of being able to move up and down; preferably, three long holes 21 are arranged in the rear side of the telescopic section frame 20, and the telescopic section frame 20 and the telescopic frame 18 are pre-tightened by 3 sets of fasteners 22 passing through the three sets of long holes 21, so as to increase the structural rigidity of the connection between the telescopic section frame 20 and the telescopic frame 18.

Figure 9:
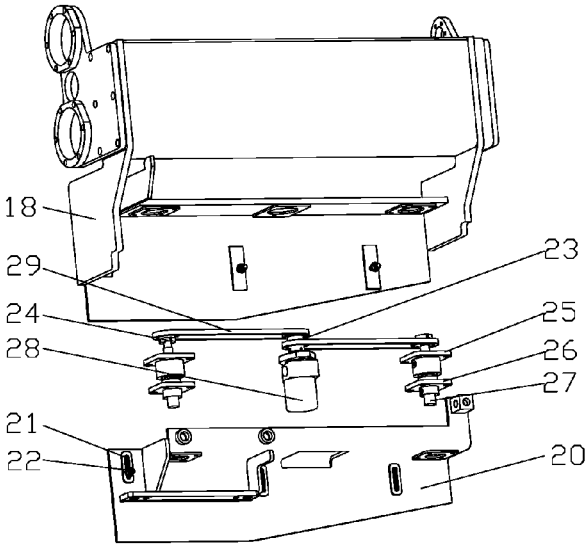
FIG. 9 is an exploded schematic view of the three-dimensional structure of the elevation driver and the components connected thereto of the telescopic screed of the present invention.

As shown in FIG. 9, the elevation difference driver 23 is connected between the telescopic frame 18 and the telescopic section frame 20, so as to adjust the height of the telescopic section frame 20 relative to the telescopic frame 18; specifically, the elevation difference driver 23 comprises two sets of transversely-arranged screw thread adjusting mechanisms 24, the screw thread adjusting mechanism comprises an upper bracket 25, a lower threaded seat 26 and a screw rod 27; the upper bracket 25 is mounted on the telescopic frame 18; the lower threaded seat 26 is mounted on the telescopic section frame 20; the upper portion of the screw rod 27 is rotatably connected to the upper bracket 25, and the lower portion of the screw rod 27 is provided with external threads, and matches with the lower threaded seat 26. The height of the telescopic section frame 20 relative to the telescopic frame 18 can be adjusted by manually screwing the screw rod 27 of the elevation difference driver 23. However, in order to improve the convenience for adjustment, the elevation difference driver 23 performs driving through combination of the hydraulic motor 28 and the chain 29. The hydraulic motor 28 drives the rotation of the screw rod 27 of the screw thread adjusting mechanism 24 by the chain 29, so that the telescopic section frame 20 approaches or departs from the telescopic frame 18, thereby achieving height adjustment.

As shown in FIG. 6, the telescopic section base plate 30 is connected to the bottom of the telescopic section frame 20.

Figure 10:
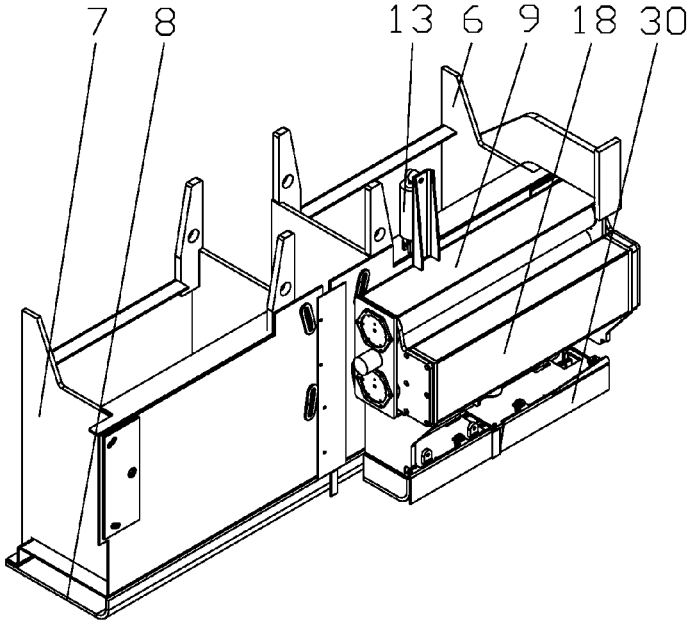
FIG. 10 is a three-dimension structural schematic view of the telescopic screed of the present invention, which has no cross slope and whose telescopic section screed is at the retracted position.
Figure 11:
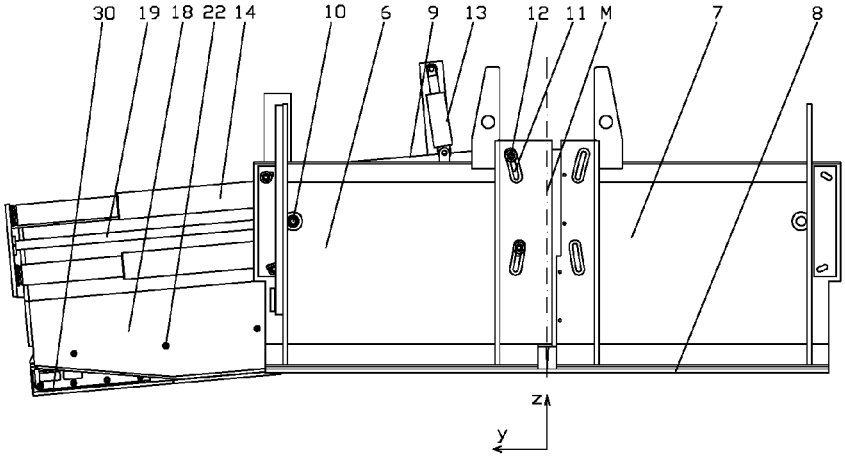
FIG. 11 is a rear view of the telescopic screed of the present invention, which has a cross slope and whose telescoping section screed is at the extended position.

As shown in FIG. 10, when the first hydrocylinder 13 which adjusts the cross slope of the cross slope framework 9 relative to the main section screed is in a retracted position, the cross slop is 0. As shown in FIG. 11, when the first hydrocylinder 13 is in an extended position, the cross slope framework 9 can pivot around the pin shaft 10 with respect to the main section screed by an angle in a plane (y-z plane) substantially perpendicular to the heading direction (x direction) of the paving, so that there is a cross slope between the main section base plate 8 of the main section screed and the telescopic section base plate 30 of the telescopic section screed, so as to spread a road surface with a cross slope.

As shown in FIG. 6, when the second hydrocyclinder 19 which drives the telescopic frame 18 and enables it to move transversely relative to the cross slope framework 9 telescopes, the outer side of the telescopic frame 18 slides transversely by means of the inner pipe 17 of the two-stage sliding pipe 14, and the inner side of the telescopic frame 18 slides transversely along the outer pipe 15 of the two-stage sliding pipe 14. Therefore, when the second hydrocylinder 19 is in the retracted position, the telescopic section screed is also in a retracted position. When the second hydrocylinder 19 is in an extended position, the telescopic section screed is also in an extended position.

When the elevation difference driver 23 drives the rotation of the screw rod 27 of the screw thread adjusting mechanism 24 by the hydraulic motor 28 and the chain 29, the telescopic section frame 20 moves up and down with respect to the telescopic frame 18. When the external threads at the lower portion of the screw rod 27 and the threaded hole of the matching lower threaded seat 26 of the screw thread adjusting mechanism 24 are right-hand threads, the telescopic section frame 20 moves downward with respect to the telescopic frame 18 if the screw rod 27 rotates counterclockwise (namely the negative direction of z axis from a top view), and the telescopic section frame 20 moves upward with respect to the telescopic frame 18 if the screw rod 27 rotates clockwise (from a top view).

The present invention also discloses a paving machine comprising the screed provided in the above embodiment.

As seen from the structure of the telescopic screed of the present invention and the functions of the specific structure, the telescopic screed of the present invention has the following advantages over the screed in the prior art:

1. The telescopic screed of the present invention takes a multi-stage sliding pipe as a guiding part, and the extended-out portion of the pipe of each stage can be at most about half of its length, namely, the portion that doesn't extend out is at least about half of its length (the inner pipe of the two-stage sliding pipe extends out about half of its length, and the pipe of each stage of a multi-stage sliding pipe with more than two stages extends out less than half of its length), so the guiding performance will be improved inevitably.

2. Due to the telescopic property of the multi-stage sliding pipes, the multi-stage sliding pipes serving as guiding parts have smaller length when in the retracted state, so that the multistage sliding pipes on the left and right sides of the telescopic screed will not intersect with each other or enter into the other's space to cause interference. In this way, even when the telescopic section screed is in the retracted state, the cross slope thereof can still be adjusted, enabling favorable adaptability to various operation condition.

3. The inner side of the telescopic frame 18 supports the multistage sliding pipes while being slidably connected to the outer pipe 15 of the multistage sliding pipe. Moreover, the outer side of the telescopic frame 18 is connected to the inner pipe 17. That is, both the inner side and the outer side of the telescopic frame 18 are connected to the multistage sliding pipes, thereby increasing the structural rigidity of the telescopic screed.

4. The telescopic screed realizes transverse telescoping by only adopting two multi-stage sliding pipes and one telescopic driver at each side, so it is very compact in space, which particularly means a lot to the front telescopic screed (which often requires more compact space).

5. When the telescopic screed telescopes transversely, the lateral positions of the intersecting lines between the cross slope surfaces on both sides and the middle horizontal surface will not change, so no additional control system is necessary.

The invention claimed is:

1. A telescopic screed comprising:

a main section screed comprising a main section screed frame and a main section base plate; and telescopic section screeds arranged on a left side and/or a right side of the main section screed, the telescopic section screeds comprising:

a cross slope framework which is pivotally connected with the left side and/or the right side of the main section screed to pivot relative to the main section screed in a plane which forms an angle of 80°-90° with a travelling direction of the telescopic screed;

a cross slope driver connected with the main section screed and the cross slope framework for adjusting a cross slope of the cross slope framework relative to the main section screed;

at least two multistage sliding pipes, each comprising an outer pipe, at least one intermediate pipe and an inner pipe, which are sequentially telescoped from the outer pipe and slide relatively along an axial direction, wherein the outer pipe is transversely fixed to the cross slope framework;

a telescopic frame moving transversely relative to the cross slope framework, with an inner side thereof slidably connected to the outer pipe of the multistage sliding pipe and an outer side thereof connected to the inner pipe of the multistage sliding pipe;

a telescopic driver for driving the telescopic frame to move transversely with respect to the cross slope framework;

a telescopic section frame connected with a lower portion of the telescopic frame and movable up and down;

an elevation difference driver connected between the telescopic frame and the telescopic section frame to adjust a height of the telescopic section frame relative to the telescopic frame; and a telescopic section base plate connected to a bottom of the telescopic section frame.

2. The telescopic screed according to claim 1, wherein the cross slope framework is pivotally connected to a front side of the main section screed by a pin shaft, wherein the front side of the main section screed is provided with several arcuate holes, and wherein the cross slope framework and the main section screed are pre-tightened by fasteners passing through the several arcuate holes.

3. The telescopic screed according to claim 1, wherein the cross slope driver is a hydrocylinder, with one end thereof connected to the main section screed and the other end connected to the cross slope framework.

4. The telescopic screed according to claim 1, wherein the multistage sliding pipe is a two-stage sliding pipe, wherein the intermediate pipe and the outer pipe slide relative to each other, forming a first stroke of the two-stage sliding pipe, and the inner pipe and the intermediate pipe slide relative to each other, forming a second stroke of the two-stage sliding pipe, and wherein the first stroke equals to the second stroke.

5. The telescopic screed according to claim 1, wherein the at least two multistage sliding pipes are arranged up and down, and wherein the telescopic driver is disposed at a middle position of the at least two multi-stage sliding pipes.

6. The telescopic screed according to claim 1, wherein the telescopic driver is a hydrocylinder, with one end thereof connected to the cross slope framework and the other end connected to an outer side of the telescopic frame.

7. The telescopic screed according to claim 1, wherein a rear side of the telescopic section frame is provided with long holes, and the telescopic section frame and the telescopic frame are pre-tightened by fasteners passing through the long holes.

8. The telescopic screed according to claim 1, wherein the elevation difference driver comprises two sets of transversely-arranged screw thread adjusting mechanisms, and wherein the screw thread adjusting mechanisms comprise an upper bracket mounted on the telescopic frame, a lower threaded seat mounted on the telescopic section frame, and a screw rod whose upper portion is rotatably connected with the upper bracket and whose lower portion is provided with external threads mating with the lower threaded seat.

9. The telescopic screed according to claim 8, wherein the elevation difference driver further comprises a hydraulic motor and a chain, and wherein the hydraulic motor drives rotation of the screw rod of the screw thread adjusting mechanism by the chain, so that the telescopic section frame approaches or departs from the telescopic frame.

10. A paving machine comprising the telescopic screed according to claim 1.

* * * * *